United States Patent [19]

Rosenthal

[11] 4,249,736

[45] Feb. 10, 1981

[54] DROP TARGET ASSEMBLY FOR PINBALL GAME

[75] Inventor: Martin B. Rosenthal, Glenwood, Ill.

[73] Assignee: Stern Electronics, Inc., Chicago, Ill.

[21] Appl. No.: 54,006

[22] Filed: Jul. 2, 1979

[51] Int. Cl.[3] ..... A63D 3/02

[52] U.S. Cl. ..... 273/127 R

[58] Field of Search ..... 273/129 R, 121 A, 121 R, 273/122 A, 122 R, 123 A, 123 R, 124 A, 125 A, 125 R, 127 R, 127 C; 200/61.11

[56] References Cited

U.S. PATENT DOCUMENTS

| | | | |
|---|---|---|---|
| 180,226 | 7/1876 | Piper et al. | 273/127 R |
| 240,334 | 4/1881 | Pittman | 273/127 R |
| 294,590 | 3/1884 | Candall | 273/127 R |
| 343,088 | 6/1886 | Striker | 273/127 R |
| 923,830 | 6/1909 | Grounds | 273/127 R |
| 1,325,921 | 12/1919 | Amile | 273/127 R |
| 1,534,522 | 4/1925 | Holliday | 273/127 R |
| 1,949,488 | 3/1934 | Rockala | 273/121 A |
| 2,095,513 | 10/1937 | Reznick | 273/122 R |
| 3,078,096 | 2/1963 | Wisner | 273/127 R |

*Primary Examiner*—Richard C. Pinkham
*Assistant Examiner*—T. Brown
*Attorney, Agent, or Firm*—Merriam, Marshall & Bicknell

[57] ABSTRACT

A pinball game contains a plurality of drop target members each mounted for vertical movement between a raised position, above the playfield of the pinball game, and a lowered position below the playfield. Each target member is maintained in its raised position by a latch, and the target member may be knocked off its latch by impact from a pinball, causing the target member to drop to its lowered position. A latch may be withdrawn from a supportive position for its target member, causing the target member to drop without having undergone impact by a pinball. Structure is provided to elevate the target members to their raised positions, and there is a controller programmed to withdraw selected latches following the elevation of the target members.

9 Claims, 8 Drawing Figures

DROP TARGET ASSEMBLY FOR PINBALL GAME

BACKGROUND OF THE INVENTION

The present invention relates generally to pinball games and more particularly to a drop target assembly for a pinball game.

In a pinball game, a pinball is propelled into play on a playfield and strikes various elements with each strike typically registering a score. Among these elements are drop targets which are strip-like members mounted for vertical movement between an upper position in which the target member is located above the surface of the playfield and a lower position in which the target member is located below the playfield. The drop target member is normally maintained in its raised position by a latch which permits the target member to drop to its lower position in response to impact, from a pre-determined direction, by a pinball in play on the playfield. When the target member drops from its raised to its lowered position, a score is registered.

Normally, drop target members are arranged in banks or groups, e.g., with four or five drop target members in a group. Conventionally, all target members in a group are elevated simultaneously to their raised positions and initially maintained there, and then each target member is dropped to its lowered position individually in response to the impact of a pinball on that particular drop target member. When all the target members in a group have been dropped to their lowered position, a switch is closed which actuates a mechanism to elevate all of the drop target members in the group simultaneously back to their raised positions, and the entire sequence is then repeated.

The procedure described in the preceding paragraph is conventional for operating a group of drop target members. However, the conventional procedure offers little variation in play and, after awhile, may become dull or boring to the pinball player who typically seeks a variation in challenges to his skill.

SUMMARY OF THE INVENTION

In accordance with the present invention, a mechanism is provided for varying the number and arrangement of drop target members which are exposed to impact by a pinball at various times during a given pinball game. For example, assume that, in the initial stages of the game, all five drop target members in a group have been elevated to and maintained in their raised positions, at least initially, and then, one by one, the members are dropped to their lowered positions in response to the impact of a pinball on individual members of the group. However, when this occurs in a pinball game of the present invention, all five members of the group are not both elevated to and then maintained in their raised positions. Instead, although the entire group is elevated, less than the entire group is maintained in the raised position.

For example, elevated members 1, 3 and 5 may be maintained in their raised position while elevated members 2 and 4 drop to their lowered position before a pinball is put into play. Then, when the three raised members (1, 3 and 5) have been dropped to their lowered position in response to individual impacts by a pinball, a third and different arrangement of drop target members is maintained in the raised position, e.g., members 2 and 4, for example, with members 1, 3, and 5 being dropped to their lowered position. This type of variation continues for essentially the length of the game, with a different number and arrangement of target members being maintained in the raised position each time a group is elevated.

The particular number and arrangement of target members and the sequence in which the different arrangements of target members are raised during a game is governed by a controller unit comprising a microprocessor connected to the drop target assembly. Each time all target members in a group attain the lowered position, the controller actuates mechanism which changes the number or arrangement, or both, of drop target members which are maintained in the raised position in accordance with a sequence which has been programmed into the microprocessor.

Appropriate mechanical and electromechanical structure is provided to inform, and respond to the orders of, the controller.

Other features and advantages are inherent in the structure claimed and disclosed or will become apparent to those skilled in the art from the following detailed description in conjunction with the accompanying diagramatic drawing.

DETAILED DESCRIPTION

Figure 1:
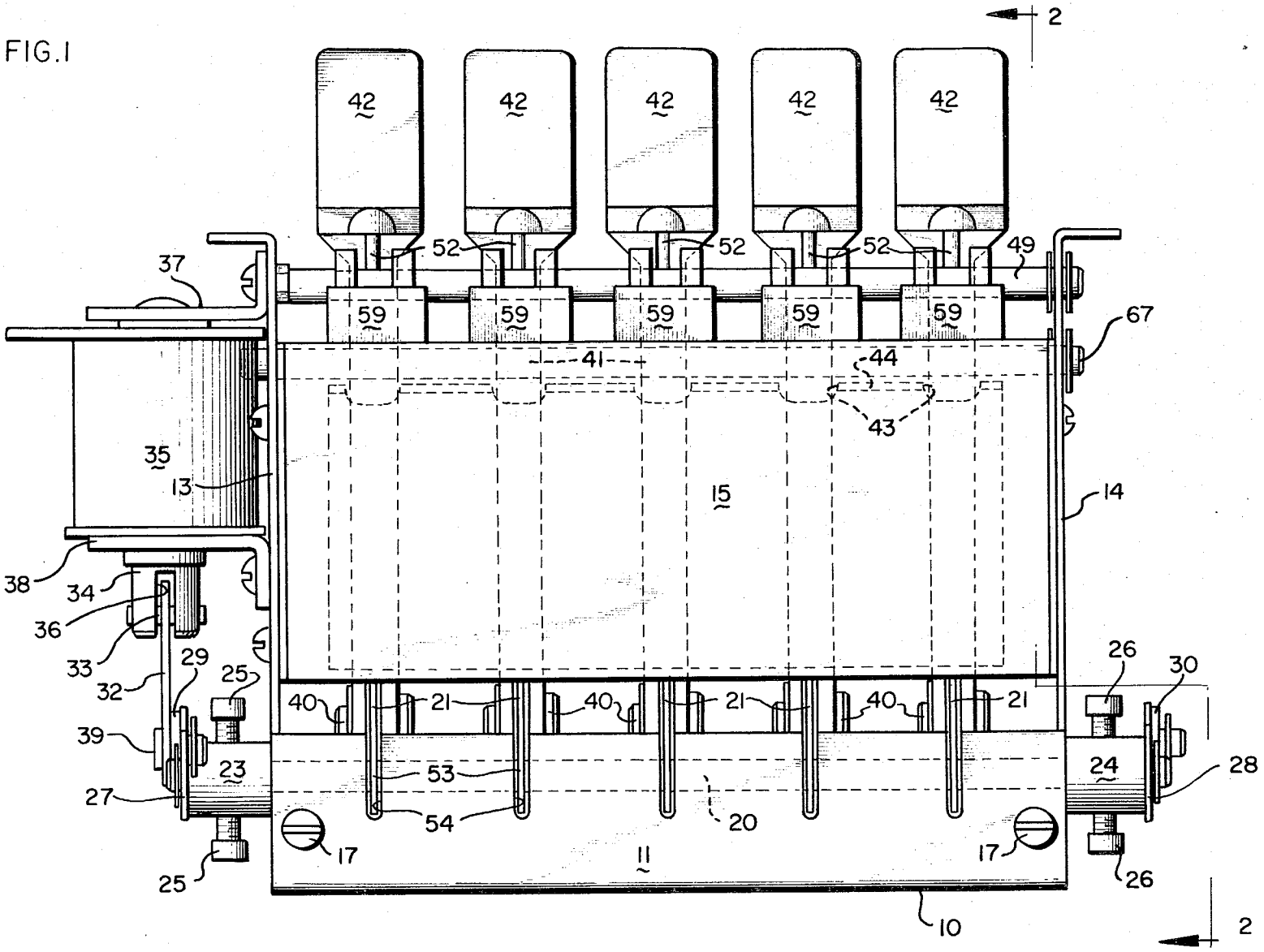
FIG. 1 is a front view of a drop target assembly in accordance with an embodiment of the present invention.
Figure 3:
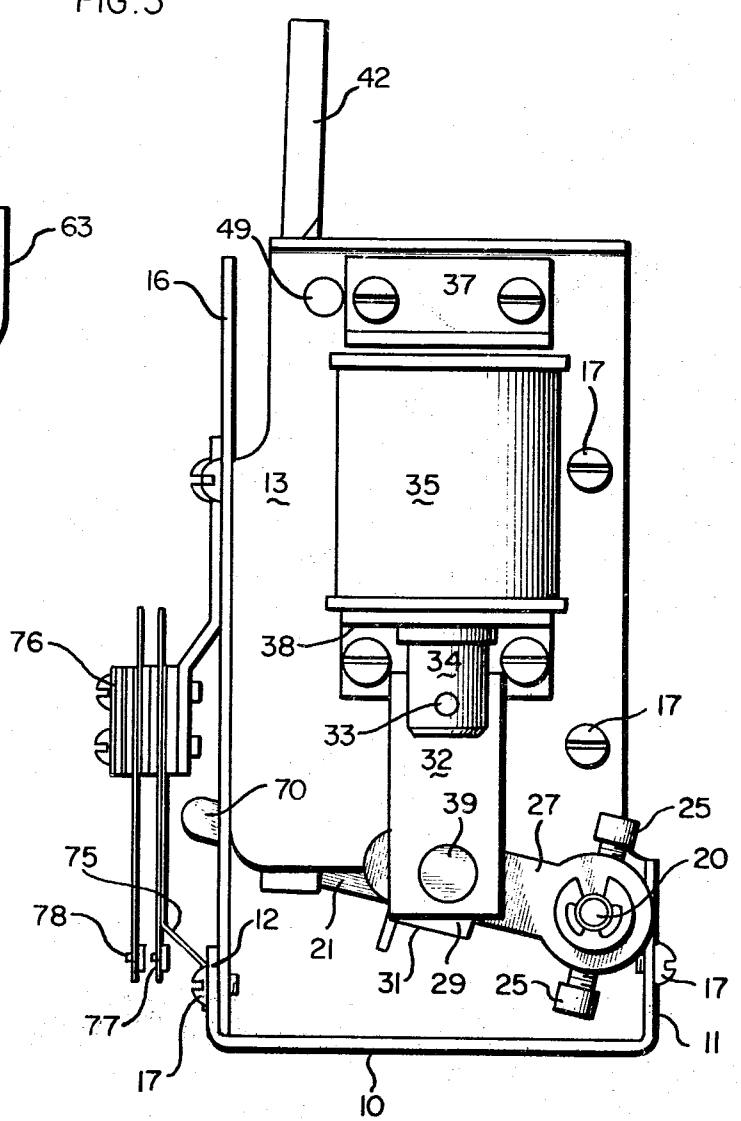
FIG. 3 is a side view of the assembly, viewed from the left in FIG. 1.
Figure 8:
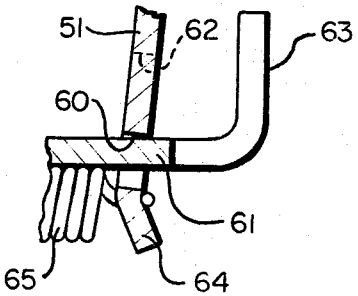
FIG. 8 (sheet 2) is an enlarged, fragmentary vertical, sectional view of a portion of the assembly.

Referring initially to FIGS. 1–6 there is shown a drop target assembly constructed in accordance with an embodiment of the present invention. The drop target assembly includes a sheet metal frame comprising a base member 10 having front and rear flanges 11, 12, respectively. The sheet metal frame also includes first and second side frame members 13, 14, respectively and front and back frame members 15, 16, respectively. The various members of the sheet metal frame 10–16 are connected together by conventional fastening means such as screws 17.

Extending between first and second side frame members 13 and 14 and freely, pivotally mounted thereon is a shaft 20 on which are freely pivotally mounted a plurality of link members 21 extending rearwardly from their mounting on shaft 20 toward back frame member 16. Opposite ends of shaft 20 extend outwardly beyond side frame members 13, 14, and shaft 20 is held against axial movement relative to side frame members 13, 14, by spacer members 23, 24 attached by screws 25, 26 to respective opposite ends of shaft 20.

Mounted on each opposite end of shaft 20 is one end of a respective connecting element 27, 28 extending rearwardly from shaft 20 and terminating at another end pivotally connected to a respective opposite flange 29, 30 of an elevating bar 31. Connecting element 27 is also pivotally connected at 39 (FIGS. 1 and 3) to the bottom end of a vertical link element 32 extending upwardly and terminating at another end located within a slot 36 in a reciprocating arm 34 of a solenoid 35. Vertical link element 32 is pivotally connected at 33 to solenoid arm 34.

Solenoid 35 is mounted to side frame member 13 by upper and lower attachment brackets 37, 38, respectively. Actuation of solenoid 35 raises solenoid arm 34 and vertical link element 32 upwardly, in turn causing connecting elements 27, 28 to pivot upwardly about the axis of shaft 20. This raises elevating bar 29, in turn causing link members 21 to pivot upwardly about the axis of shaft 20.

The rearward end of each link member 21 is pivotally connected at 40 to the bottom end of a shank 41 of a drop target member 42. Drop target member 42 and its shank 41 move up and down with the rearward end of its corresponding link member 21, and shank member 41 is guided, during its vertical movement, by a slot 43 in the flange 44 of a guide member 45 attached to back frame member 16.

As noted above, the actuation of solenoid 35 raises elevating bar 29 which in turn pivots link members 21 upwardly. This elevates each of the drop target members 42 from the lowered position of FIG. 6 to the raised position of FIG. 2.

When a target member 42 is elevated to its raised position, it is normally maintained there by the engagement of a latch finger 50 of a latch 51 beneath a protrusion 52 on target member 42. The cooperation of latch finger 50 and target member protrusion 52 maintain the target member in its raised position until either target member 42 is pushed off latch finger 50 or the latch finger is withdrawn from under protrusion 52 on the target member.

Also cooperating to maintain target member 42 in a latching relationship with latch finger 50 is a spring 46 having a lower end connected at 47 to a middle part of link member 21 and an upper end connected at 48 to an upper part of shank 41 of the drop target member. Spring 46 normally urges drop target member 42 to pivot about the axis of pivotal connection 40, in a frontward direction, and this pivotal action is limited by the engagement of protrusion 52 with a stop bar 49 extending between first and second side frame members 13, 14.

Latch finger 50 is normally maintained in an operative position for engaging beneath the bottom of target member protrusion 52 by structure shown in FIGS. 2, 4, 6 and 8.

Figure 2:
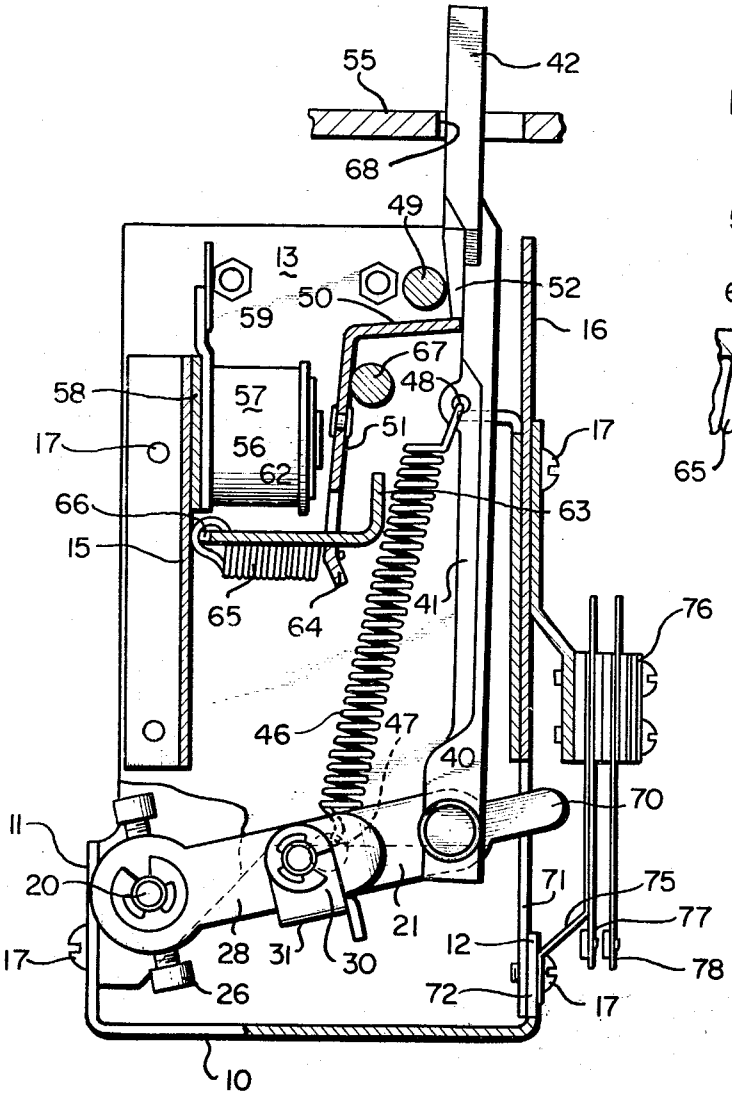
FIG. 2 is a vertical sectional view taken along line 2—2 in FIG. 1, showing a drop target member in a raised position.
Figure 4:
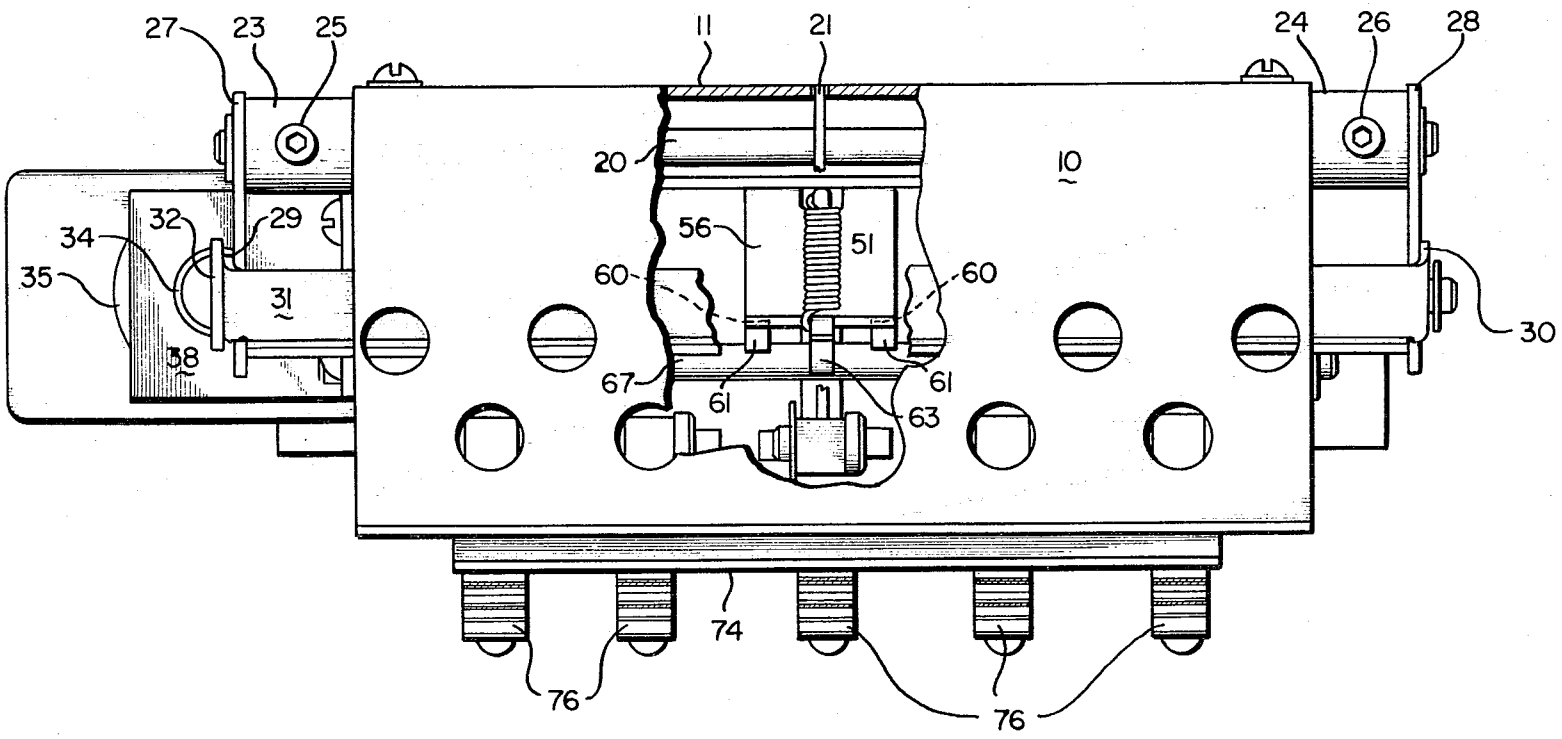
FIG. 4 is a bottom view of the assembly.
Figure 6:
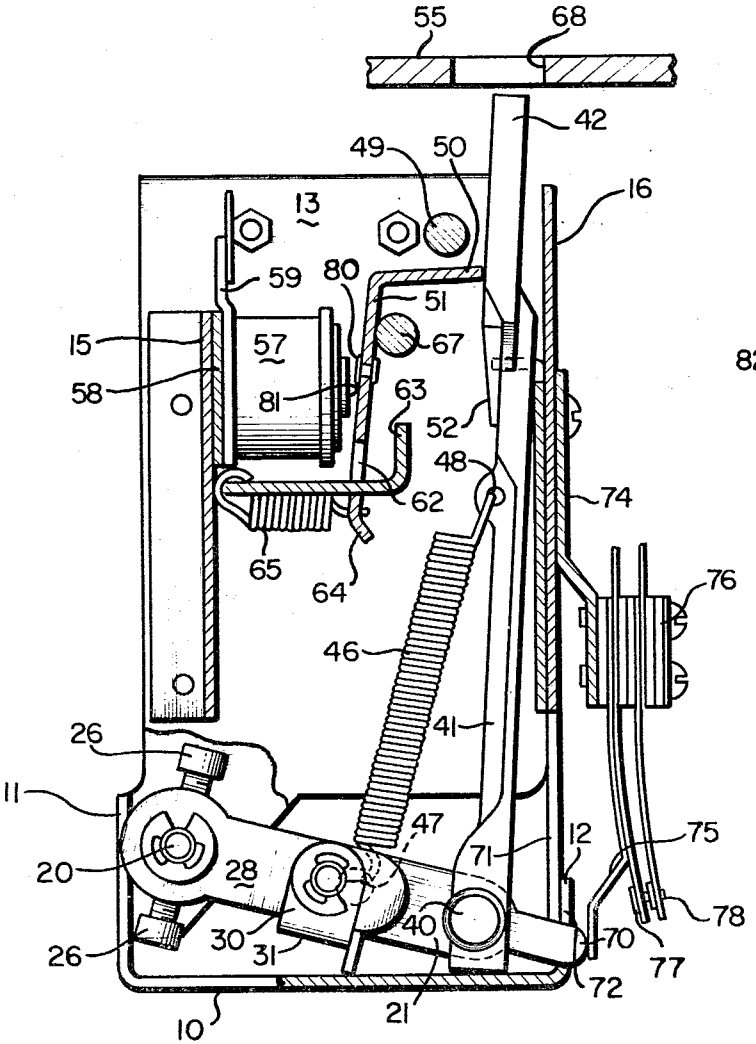
FIG. 6 is a sectional view, similar to FIG. 2, showing a drop target member in a lowered position.

Latch 51 is mounted, on a latch bracket 56, for rocking movement between a rearward, operative or latching position illustrated in FIGS. 2 and 6 and a forward, inoperative position in which latch 51 engages against a solenoid electromagnet 57 mounted on a front flange 58 of latch bracket 56. Flange 58 is in turn mounted on front frame member 15.

Located along opposite vertical margins of latch 51, near the bottom thereof, are a pair of slots 60, 60 (FIGS. 4 and 8) through which extend a pair of fingers 61, 61 at the rear of latch bracket 56. Latch 51 also includes, near its bottom end, an opening 62 through which extends a tongue 63 at the rear end of latch bracket 56. Tongue 63 curves upwardly to help maintain latch 51 on latch bracket 56. The bottom of latch 51 is connected, below latch bracket 56, at an ear 64 to one end of a coil spring 65 having another end connected at 66 to the forward end of latch bracket 56. Coil spring 65 rocks latch 51 on latch bracket 56, rearwardly to the operative position illustrated in FIG. 2. A stop bar 67 limits rearward movement of latch 51. Stop bar 67 is composed of nonmagnetic material such as brass and extends between side frame members 13, 14.

When target member 42 is in its raised position (FIG. 2), it normally projects above the top surface 55 of the playfield on a pinball game, through a slot 68. When target member 42 is struck by a ball, moving in a direction from the front to the rear of the drop target assembly (to the right in FIG. 2), the drop target member is caused to pivot to the rear about the axis of pivotal connection 40 located at the lower end of drop target shank 41. This is pivotal movement in a clockwise sense as viewed in FIG. 2. When this occurs, the protrusion 52 on drop target member 42 is pushed off the rearward end of latch finger 50, and the drop target member falls from the raised position of FIG. 2 to the lowered position of FIG. 6.

Each of the drop target members 42 is mounted for movement, independent of the other drop target members, between its raised position (FIG. 2) and its lowered position (FIG. 6) in which the drop target member is located below the playfield. When a drop target member 42 is located below the playfield, it is no longer visible to a player and is no longer a target for a pinball.

Figure 5:
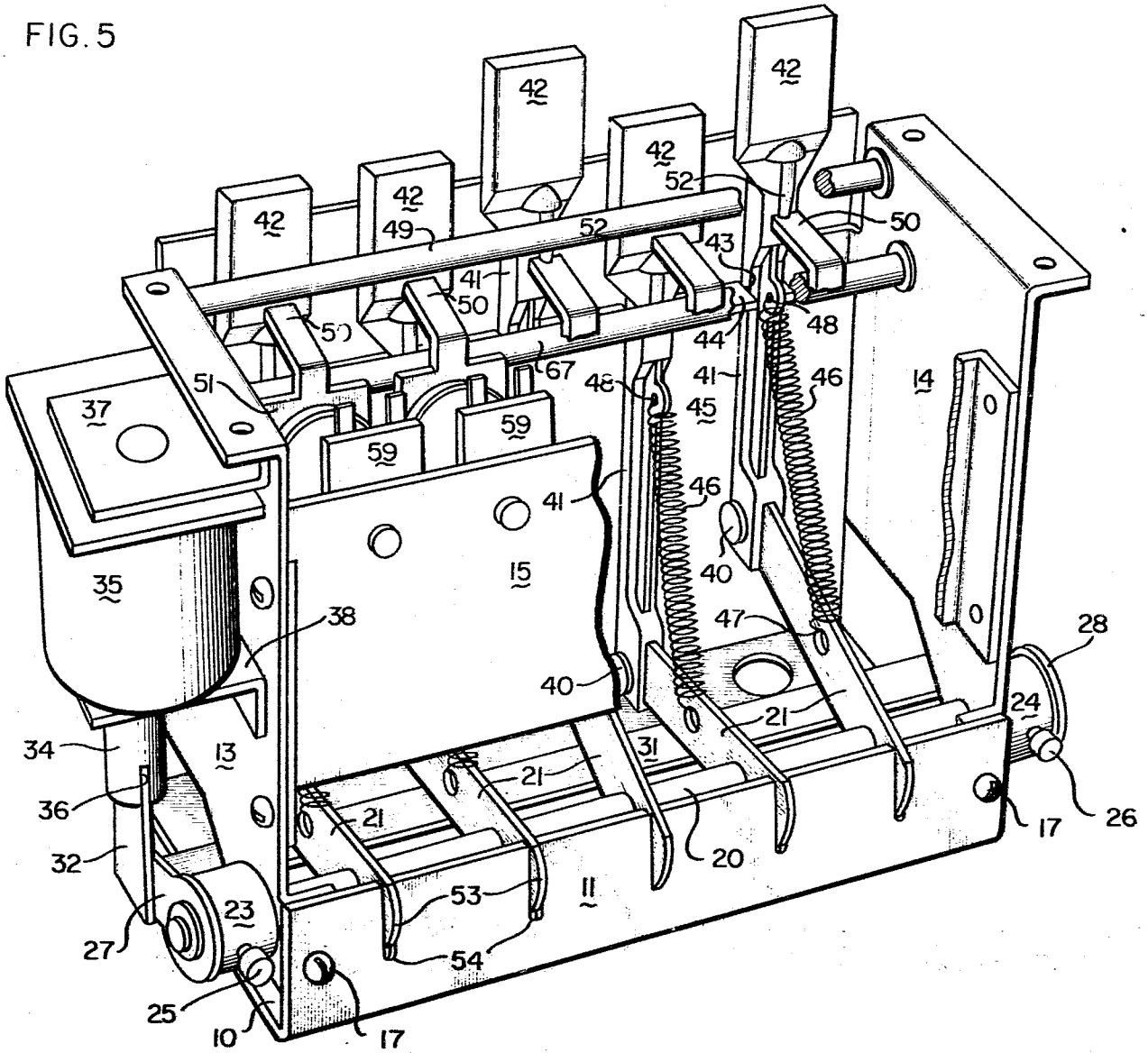
FIG. 5 is a perspective, partially cut away, of the assembly.

As a target member 42 drops, the link member 21 connected thereto also drops, pivoting about the axis of shaft 20, from the position illustrated in FIG. 2 to the position illustrated in FIG. 6. Link member 21 includes, at its rearward end, a terminal portion 70. During pivotal movement of the link member, terminal portion 70 is received in and guided by a slot 71 in back frame member 16 and a slot 72 in rear flange 12 of base member 10. Also, the front end 53 of each link member is received and guided within a guide slot 54 in front flange 11 of base member 10 (FIG. 5).

As link member 21 drops from the position of FIG. 2 to the position of FIG. 6, terminal portion 70 engages a cam member 75 on a switch 76 and closes or engages the terminals 77, 78 of switch 76. Switch 76 is mounted by a bracket 74 on back frame member 16. There is a switch 76 for each drop target member 42 and its corresponding link member 21. When all of the switches 76 for each of the drop target members in the assembly have been closed, solenoid 35 is actuated to raise elevating bar 31, in turn elevating all of the drop target members 42 back to the raised positions of FIG. 2.

When the drop target members 42 are elevated to their raised positions by the elevating bar 31, normally all of the drop target members in the assembly are engaged by their respective latches, and, absent the actuation of some additional mechanism, all of the drop target members in the assembly will be maintained in the raised position each time they are elevated to that position by elevating bar 31. Now to be described is a mechanism which is actuable to cause selective drop target members in the assembly to be dropped to their lowered positions, out of play, after all the drop target members in the assembly have been elevated to their raised positions.

As noted above, located adjacent each rockable latch 51 is a solenoid electromagnet 57, one for each latch. An electromagnet 57 and its corresponding rockable latch 51 together constitute a form of solenoid. When the electromagnet 57 for a given latch 51 is energized or actuated, the corresponding latch is urged frontwardly toward electromagnet 57 until a contact element 80 on latch 51 engages a contact element 81 on electromagnet 57. When latch 51 is thus retracted, it is no longer in a position in which latch finger 50 will engage beneath protrusion 52 on the corresponding drop target member 42 when the latter is in its raised position. Accordingly, when elevating bar 31 is dropped to its normal, lowered position, all those drop target members 42 which are unsupported by a latch finger 50, will also drop to their lowered positions.

In a normal sequence of operation, elevating solenoid 35 is actuated only long enough to cause elevating bar 31 to elevate all of the drop target members 42 to their raised position and to allow latch fingers 50 to engage beneath protrusions 52. Then, elevating solenoid 35 is deactuated, causing elevating bar 31 to drop by gravity to its lowered position. Next, predetermined latch-retracting electromagnets 57 are actuated, but only long enough to permit the corresponding drop target members to drop to their lowered positions, following which these latch-retracting electromagnets 57 are deactuated, allowing the corresponding latches 51 to return to their normal position, illustrated in FIG. 2, in response to the urging of coil springs 65.

Figure 7:
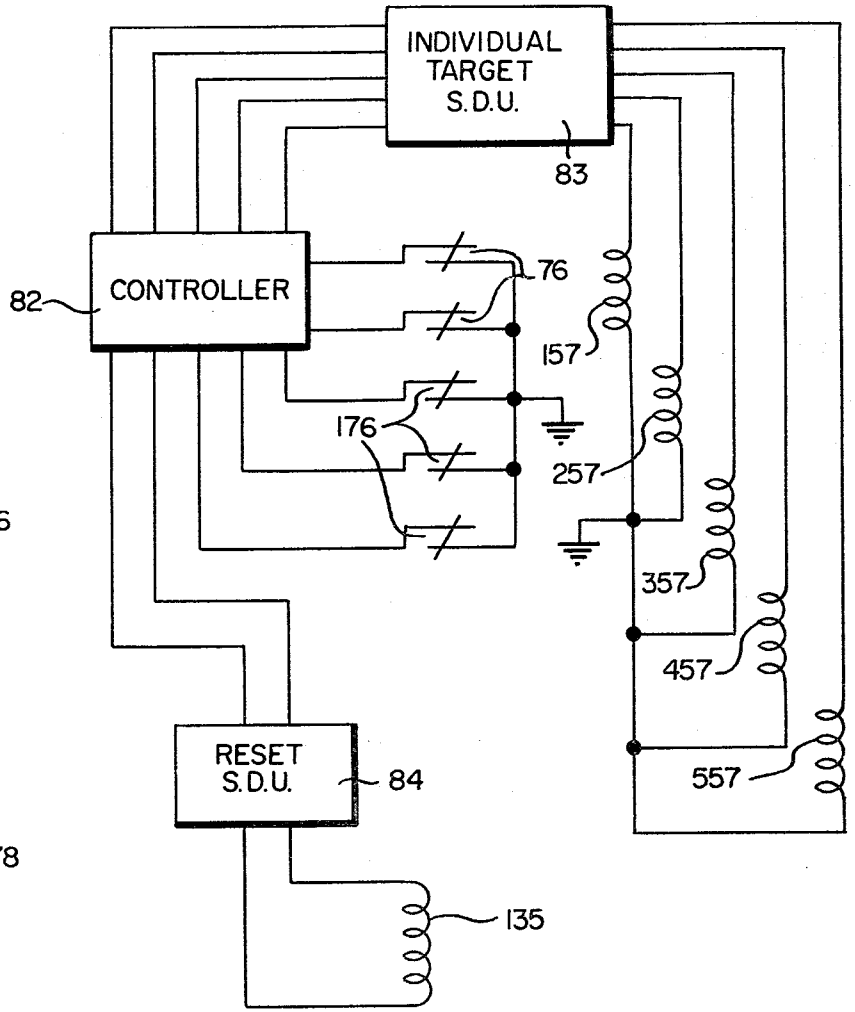
FIG. 7 is a schematic diagram illustrating some of the electrical components in the assembly.

The drop target assembly includes a mechanism operable to actuate individual latch-retracting electromagnets 57 in accordance with a predetermined program, and this mechanism will now be described, with reference to FIG. 7. Each of the switches 76 is connected to a controller 82 in turn conncted to an individual target solenoid driving unit (S.D.U.) 83 as well as a reset solenoid driving unit (S.D.U.) 84. Controller 82 comprises a microprocessor which includes a read only memory unit, input and output coupling circuits, and the like. It is of conventional construction and may be programmed to perform the functions described below.

Reset solenoid driving unit 84 is connected to a coil 135 of elevating solenoid 35. When all of the switches 76 have been closed, this is noted by controller 82 which, in turn, sends a signal to reset solenoid driving unit 84 which energizes coil 135 in elevating solenoid 35 to actuate solenoid 35 and raise elevating bar 31.

Individual target solenoid driving unit 83 is connected to a plurality of coils 157–557 each for actuating a respective electromagnet 57. Each time all of the switches 76 are closed, various combinations of the coils 157–557 are actuated in accordance with a predetermined program which has been set into unit 82. For example, the first time controller 82 senses that all of switches 76 have been closed, it will instruct unit 83 to actuate only coils 157 and 557. This would cause the target members corresponding to coils 157 and 557 to drop, closing their corresponding switches 76, while leaving in their raised positions the target members corresponding to coils 257, 357 and 457. Subsequently, when the switches 76 for the target members corresponding to coils 257, 357 and 457 have been closed, by the dropping of their corresponding target members in response to impact by a pinball, controller 82 will send another instruction to unit 83, this time to actuate coils 257 and 457, for example. The next time all of the switches 76 have been closed, controller 82 will send a still different instruction to unit 83, and so on, for each of the times controller 82 senses that all the switches 76 are closed.

The result is that only those drop target members whose particular coil among the coils 157–557 has been energized, will initially drop before a pinball is put into play, while the remainder of the target members will remain in the raised position. This causes a different combination of targets to remain for presentation to the pinball on the playfield each time the elevating bar is raised and lowered.

The particular number, arrangement and sequence in which target members remain in the raised position depends upon the particular program initially entered into controller 82, and this may vary from one controller 82 to another.

The actuation of a given electromagnet coil within the group of coils 157–557 depends not only upon the dropping to its lowered position of the target member corresponding to that given coil, but, also, it depends upon the dropping to their lowered positions of target members corresponding to other coils in the group 157–557, in response to impact by a pinball.

The foregoing detailed description has been given for clearness of understanding only, and no unnecessary limitations should be understood therefrom, as modifications will be obvious to those skilled in the art.

I claim:

1. A drop target assembly for a pinball game wherein pinballs are put in play on a playfield, said drop target assembly comprising:

a plurality of target members;

means mounting each of said target members for movement, independent of the other target members, between a raised position in which the target member extends above said playfield and a lowered position in which the target member is located below the playfield;

means actuable to elevate each target member to its raised position;

a plurality of latch means, one for each target member;

means mounting each latch means for movement, independent of the other latch means, between operative and inoperative positions;

means normally urging each latch means toward its operative position;

each of said latch means and its correponding target member comprising means cooperating to hold the target member in its raised position, when the latch means is in an operative position, and for permitting the target member to drop to its lowered position in response to impact, from a predetermined direction, by a pinball in play on the playfield;

means, for each latch means, actuable to move said latch means from its operative to its inoperative position, thereby permitting the corresponding target member to drop to its lowered position;

means operable to actuate individual latch-moving means in accordance with a predetermined program;

and means for operating said actuating means in response to the movement of a predetermined number of said target members from their raised to their lowered positions.

2. A drop target assembly as recited in claim 1 and comprising:

means for actuating said target member-elevating means in response to the assumption of a lowered position by a predetermined number of said target members.

3. A drop target assembly as recited in claim 2 wherein:

said means for actuating said target member-elevating means comprises read-only-memory means.

4. A drop target assembly as recited in claim 3 wherein:

said read-only-memory means also comprises said means operable to actuate individual latch-moving means.

5. A drop target assembly as recited in claim 1 wherein:

said means operable to actuate individual latch-moving means comprises read-only-memory means operated in response to the assumption of a lowered position by a predetermined number of said target members.

6. A drop target assembly as recited in claim 1 wherein:

said means actuable to move said latch means comprises solenoid means.

7. In a drop target assembly for a pinball game wherein pinballs are put in play on a playfield:

means mounting said target member for movement between a raised position in which the target member extends above said playfield and a lowered position in which the target member is located below the playfield;

means actuable to elevate said target member to its raised position;

a latch means for said target member;

means mounting said latch means for movement between operative and inoperative positions;

means normally urging said latch means toward its operative position;

said latch means and said target member comprising means cooperating to hold the target member in its raised position, when the latch means is in an operative position, and for permitting the target member to drop to its lowered position in response to impact, from a predetermind direction, by a pinball in play on the playfield;

means actuable to move said latch means from its operative to its inoperative position, thereby permitting said target member to drop to its lowered position;

and means for actuating said latch-moving means in response to a predetermined occurrence involving the movement of a pinball on said playfield.

8. In a drop target assembly as recited in claim 7:

another drop target member;

means mounting said other drop target member for movement, independent of said first-recited drop target member, between a raised position in which said other drop target member extends above said playfield and a lowered position in which the other drop target member is located below the playfield;

means for elevating said other target member to its raised position;

and means for holding the other target member in its raised position and for permitting the other target member to drop to its lowered position in response to impact, from a predetermined direction, by a pinball in play on the playfield;

said means for actuating said latch-moving means comprising means for doing so in response to the movement of said other drop target member from its raised to its lowered position in response to said impact by said pinball.

9. In a drop target assembly as recited in claim 8 wherein:

said latch-moving means comprises solenoid means.

* * * * *